US006914688B2

(12) United States Patent
Inana

(10) Patent No.: US 6,914,688 B2
(45) Date of Patent: Jul. 5, 2005

(54) PRINTER FOR USE WITH ROLLED RECORDING PAPER

(75) Inventor: Katsuya Inana, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 877 days.

(21) Appl. No.: 09/757,564

(22) Filed: Jan. 11, 2001

(65) Prior Publication Data

US 2001/0007503 A1 Jul. 12, 2001

(30) Foreign Application Priority Data

Jan. 12, 2000 (JP) ..... 2000-003245

(51) Int. Cl.[7] ..... G06K 15/00
(52) U.S. Cl. ..... 358/1.12; 358/1.1
(58) Field of Search ..... 358/1.1, 1.5, 1.9, 358/1.12, 1.15, 1.18, 1.14, 1.8, 1.13

(56) References Cited

U.S. PATENT DOCUMENTS 5,018,416 A * 5/1991 Freermann ..... 83/14
5,524,844 A * 6/1996 McCormick et al. ..... 242/562
6,246,486 B1 * 6/2001 Takahashi ..... 358/1.13
6,435,117 B2 * 8/2002 Codos et al. ..... 112/475.08
2001/0004284 A1 * 6/2001 Fukuda et al. ..... 355/29
2001/0008596 A1 * 7/2001 Mogi ..... 400/578

FOREIGN PATENT DOCUMENTS

JP 11-292360 10/1999 ..... B65H/19/12

* cited by examiner

*Primary Examiner*—Gabriel Garcia
(74) *Attorney, Agent, or Firm*—Sughrue Mion, PLLC

(57) ABSTRACT

Before a newly loaded roll of recording paper is fed out from the paper magazine, a recording paper roll is put in a paper magazine, a pre-cut detection lever (53) pushes an actuation strip of a pre-cut detection switch (58) to turn on the pre-cut detection switch. As the recording paper is first fed out from the paper magazine, the pre-cut detection lever is pushed by a leading end of the recording paper, to rotate to an erected position, thereby turning off the pre-cut detection switch. Thereafter, a pre-cutting process is effected on the recording paper. A holding lever (55) holds the pre-cut detection lever at the erected position, so the pre-cut detection switch is maintained off, once the recording paper is fed out from the paper magazine, even if the recording paper is rewound into the paper magazine. So long as the pre-cut detection switch is off, the printer does not execute the pre-cutting process again. When the recording paper roll or a spool of the roll is removed from the paper magazine, a reset lever pushes up the holding lever to release the pre-cut detection lever. As a result, the pre-cut detection lever rotates to push the actuation strip, and thereby turn on the pre-cut detection switch.

7 Claims, 12 Drawing Sheets

PRINTER FOR USE WITH ROLLED RECORDING PAPER

BACKGROUND OF THE INVENTION

1. Field of the Invention

The present invention relates to a printer for use with rolled recording paper, and more particularly to a printer with a preliminary paper cutting device that cuts a leading end of a roll of recording paper so as to provide a rectangular leading end edge to side edges of the recording paper before starting printing an image on the recording paper.

2. Background Arts

There are many kinds of printers that use a continuous web of recording paper and cut it after printing. The continuous web of recording paper is coiled around a spool, and is loaded in a paper supply section of a printer or in a paper magazine with a pair of paper holders attached to opposite ends of the spool.

A container of the paper magazine consists of a magazine body and a lid which are formed from a moisture and light tight material. The magazine body bears the paper holders such that the spool of the rolled recording paper may turn about the paper holders. The paper magazine containing the rolled recording paper may be easily loaded in or unloaded from a printer, and may be reloaded in the printer. So the paper magazine facilitates loading and changing the recording paper.

In most cases, the leading end edge of unused roll of recording paper is not neat nor rectangular to the side edges of the recording paper. For this reason, a preliminary cutting process for providing a neat and rectangular leading end edge has conventionally been executed after a new roll of recording paper is loaded in the printer. The preliminary cutting process consists of a series steps of pulling out the recording paper from the roll, cutting the leading end at a predetermined length, ejecting the cut end portion out of the printer, and rewinding the recording paper onto the roll. In a conventional printer, the preliminary cutting process, hereinafter called simply the pre-cutting process, is effected in response to a manual operation on a particular operation switch or the like. The manual operation for the pre-cutting process increases the number of operations necessary for loading of the recording paper roll, and the user is apt to fail to do this operation.

To solve the above problems, Japanese Laid-open Patent Application No. 11-292360 suggests a copying machine that is provided with an automatic pre-cutting device for making the pre-cutting process automatically when the printer is turned on first after a new roll of recording paper is loaded therein. When loading a copying machine with a new roll, an operator pulls out a leading end of a paper. A cover is closed with this leading end of the paper being out of the copying machine. Pre-cutting process is performed when a pre-cutting sensor detects this leading end of the paper. After the pre-cutting process, the cut leading end of the paper is drawn out by hand from the cover, so the copying machine is ready to perform a copying action. Moreover, since detection of the leading end of the paper stops the pre-cutting sensor, the pre-cutting process is not performed again while the copying machine is loaded with the roll. When drawing out of the leading end of the paper has been forgotten, the pre-cutting sensor continues detecting the leading end of the paper.

However, in those printers which use the paper magazines, since it is possible to reload the paper magazine containing a partly used recording paper roll, it is necessary to discriminate between individual paper magazines, and check if the recording paper contained in the loaded paper magazine has already been subjected to the pre-cutting process. For this purpose, the user is required to register a newly used paper magazines with the printer, and the printer must be provided with devices for making the discrimination process. Which results in raising the cost of the printer.

SUMMARY OF THE INVENTION

In view of the foregoing, an object of the present invention is to provide a printer that can check if the pre-cutting has been made or not on each individual paper roll at a low cost without the need for complicated operations, even where the paper roll is contained in a paper magazine.

According to the present invention, a printer loaded with a roll of recording paper, comprises a paper supply device for feeding out the recording paper from the loaded roll; a cutting device for cutting the fed out recording paper at appropriate lengths; a control device for controlling a pre-cutting process whereby a leading end of the recording paper is cut at a predetermined length and is ejected from the printer before an image is printed on the recording paper; and a pre-cut memory device, the pre-cut memory device storing pre-cut data of a first value representing that the loaded recording paper has not gone through the pre-cutting process or pre-cut data of a second value representing that the loaded recording paper has gone through the pre-cutting process, wherein the control device refers to the pre-cut memory device and executes the pre-cutting process only when the pre-cut data has the first value.

Since the pre-cutting process is executed automatically only when the pre-cut data stored in the pre-cut memory device represents that the recording paper is not subjected to the pre-cutting process, there is no need for making complicated operations to execute the pre-cutting process, nor checking if the loaded recording paper roll has gone through the pre-cutting process.

It is preferable to design the pre-cut memory device to store the pre-cut data of the first value when the roll of recording paper or a spool of the roll is unloaded. Because the pre-cut data representing that the pre-cutting process has been executed on the recording paper roll is maintained in the pre-cut memory device unless the recording paper roll is unloaded, the pre-cutting process would not be executed insofar as the recording paper roll is replaced by another roll.

Where the roll of recording paper is contained in a paper magazine that is removably loaded in the printer, the pre-cut memory device is preferably provided in the paper magazine and is connected to the control device when the paper magazine is loaded in the printer.

According to a preferred embodiment, the pre-cut memory device comprises a pre-cut detection member that is located in a first position before the roll of recording paper is loaded, and is moved to a second position in cooperation with the recording paper being supplied from the roll into the printer for the pre-cutting process; a holding member for holding the pre-cut detection member in the second position; a resetting member for resetting the pre-cut detection member to the first position when the roll of recording paper or a spool of the roll is removed from the paper magazine; and a detection switch for outputting the pre-cut data of the first value when it detects that the pre-cut detection member is in the first position, and outputting the pre-cut data of the second value while the pre-cut detection member is in the second position.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
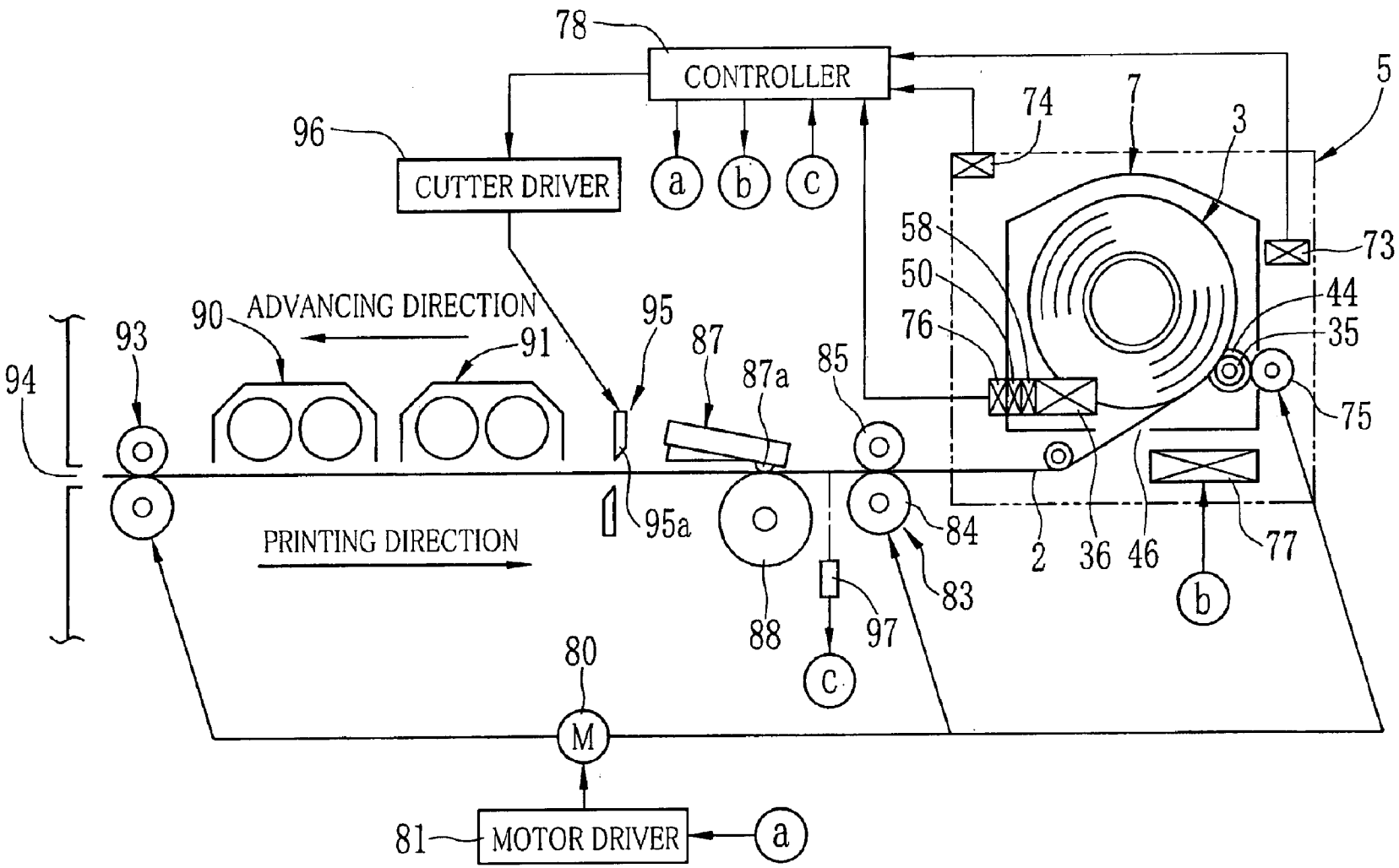
FIG. 1 is a schematic diagram illustrating a thermosensitive color printer according to an embodiment of the present invention.

In the embodiment shown in FIG. 1, the thermosensitive color printer uses a continuous web of thermosensitive color recording paper 2 that is coiled into a roll 3. The thermosensitive color recording paper 2 has a thermosensitive cyan coloring layer, a thermosensitive magenta coloring layer, a thermosensitive yellow coloring layer and a protection layer formed atop another on a base material in this order from the base material. The uppermost yellow coloring layer has the highest thermal sensitivity, so it needs the smallest heat energy for coloring. The bottommost cyan coloring layer has the lowest thermal sensitivity, so it needs the largest heat energy for coloring. The yellow coloring layer loses its coloring ability when exposed to near-ultraviolet rays of 420 nm. The magenta coloring layer has an intermediate thermal sensitivity, and loses its coloring ability when exposed to ultraviolet rays of 365 nm. The thermosensitive color recording paper 2 may have a fourth thermosensitive coloring layer, e.g. a black coloring layer.

Figure 2:
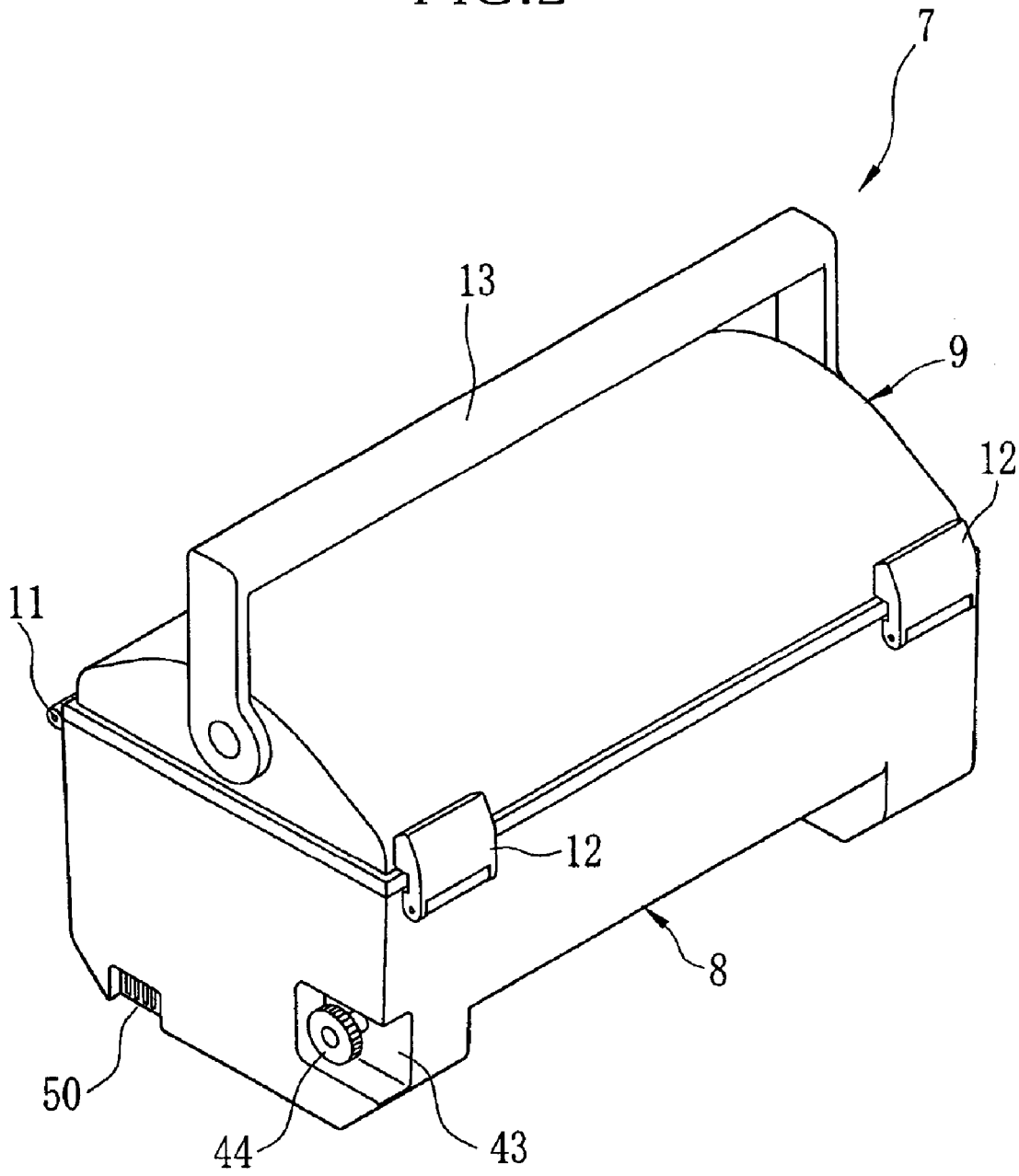
FIG. 2 is a perspective view of a paper magazine.

The recording paper roll 3 is contained in a light-tight paper magazine 4 that is removably put in a magazine chamber 5 of the printer. FIG. 2 shows the paper magazine 7 that consists of a magazine body 8 and a magazine lid 9 which are formed from a moisture and light tight plastic material. The magazine lid 9 is connected to the magazine body 8 through a hinge 11 that extends horizontally on a rear side of the paper magazine 7. A pair of lock members 12 are provided on a front side of the magazine body 8, for locking the magazine lid 9 in its closed position. A not-shown gasket member is mounted in a joint portion between the magazine body 8 and the magazine lid 9. A grip 13 is provided on the magazine lid 9 along a lengthwise direction of the paper magazine 7. The grip 13 is pivotally coupled to opposite end faces of the magazine lid 9, so the grip 13 may swing between an erected gripping position shown in FIG. 2 and a laid position. After the paper magazine 7 is loaded in the printer, the grip 13 is turned into the laid position.

Figure 3:
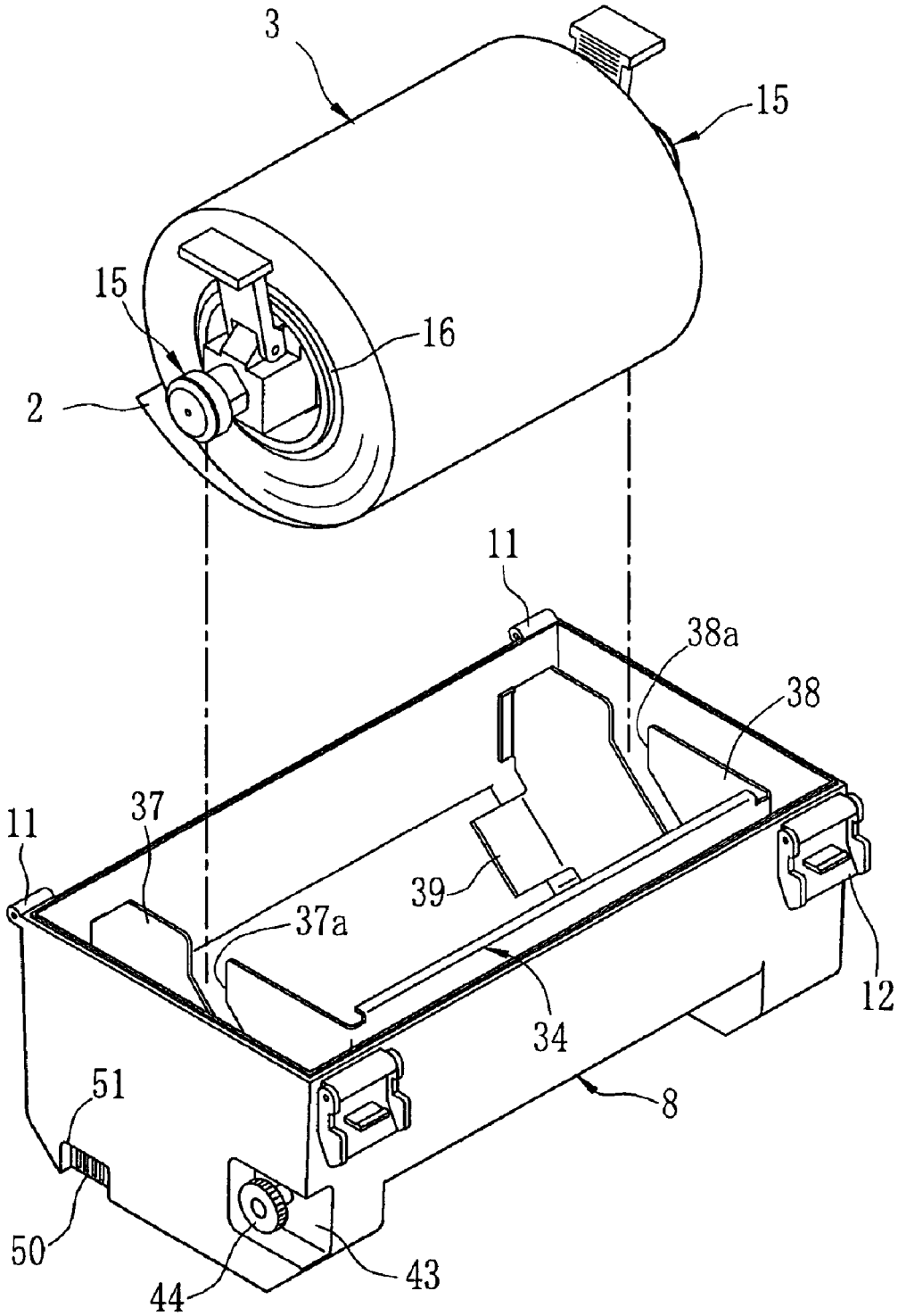
FIG. 3 is a perspective view of a magazine body and a recording paper roll with a pair of paper holders attached thereto.
Figure 4:
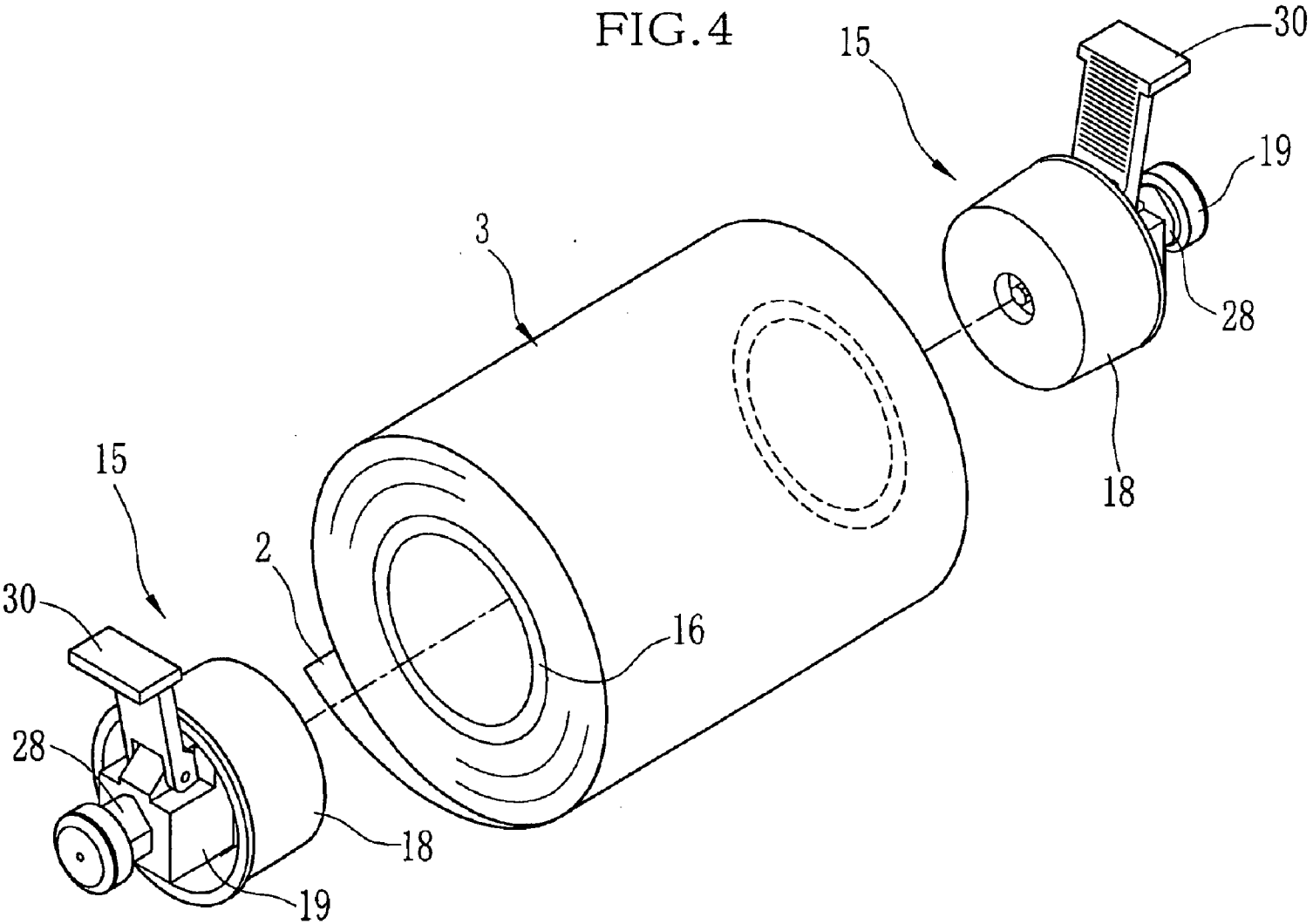
FIG. 4 is a perspective view illustrating the paper holders separated from the recording paper roll.

FIG. 3 shows the recording paper roll 3, the paper holders 15 and an interior of the paper magazine 7, wherein the magazine lid 9 is omitted for the sake of avoiding complication. The recording paper roll 3 is packed in a light-tight box or bag on the market, and a leading end of the recording paper 2 is secured by a not-shown adhesive tape to an outermost convolution of the recording paper roll 3, for preventing unwinding. To set the recording paper roll 3 in the paper magazine 7, the recording paper roll 3 is taken out of the box or bag, and a pair of paper holders 15 are attached to opposite ends of a spool 16 of the recording paper roll 3. As shown in FIG. 4, the paper holder 15 consists of a core portion 18 that is force-fitted in the end of the spool 16, and a bearing portion 19 that bears the core portion 18 such that the core portion 18 may rotate relative to the bearing portion 19.

Figure 5:
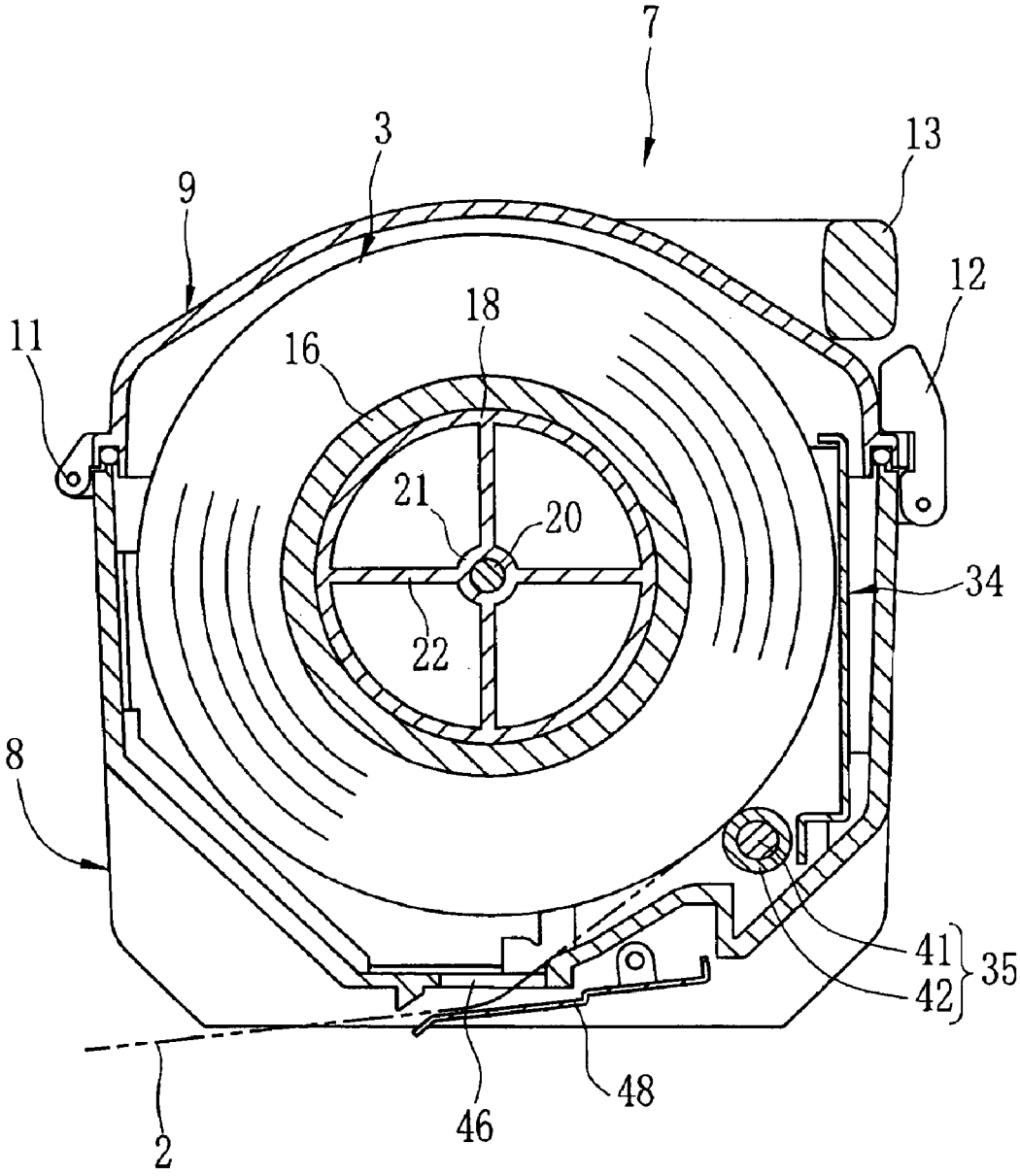
FIG. 5 is a sectional view of the paper magazine containing the recording paper roll.
Figure 6:
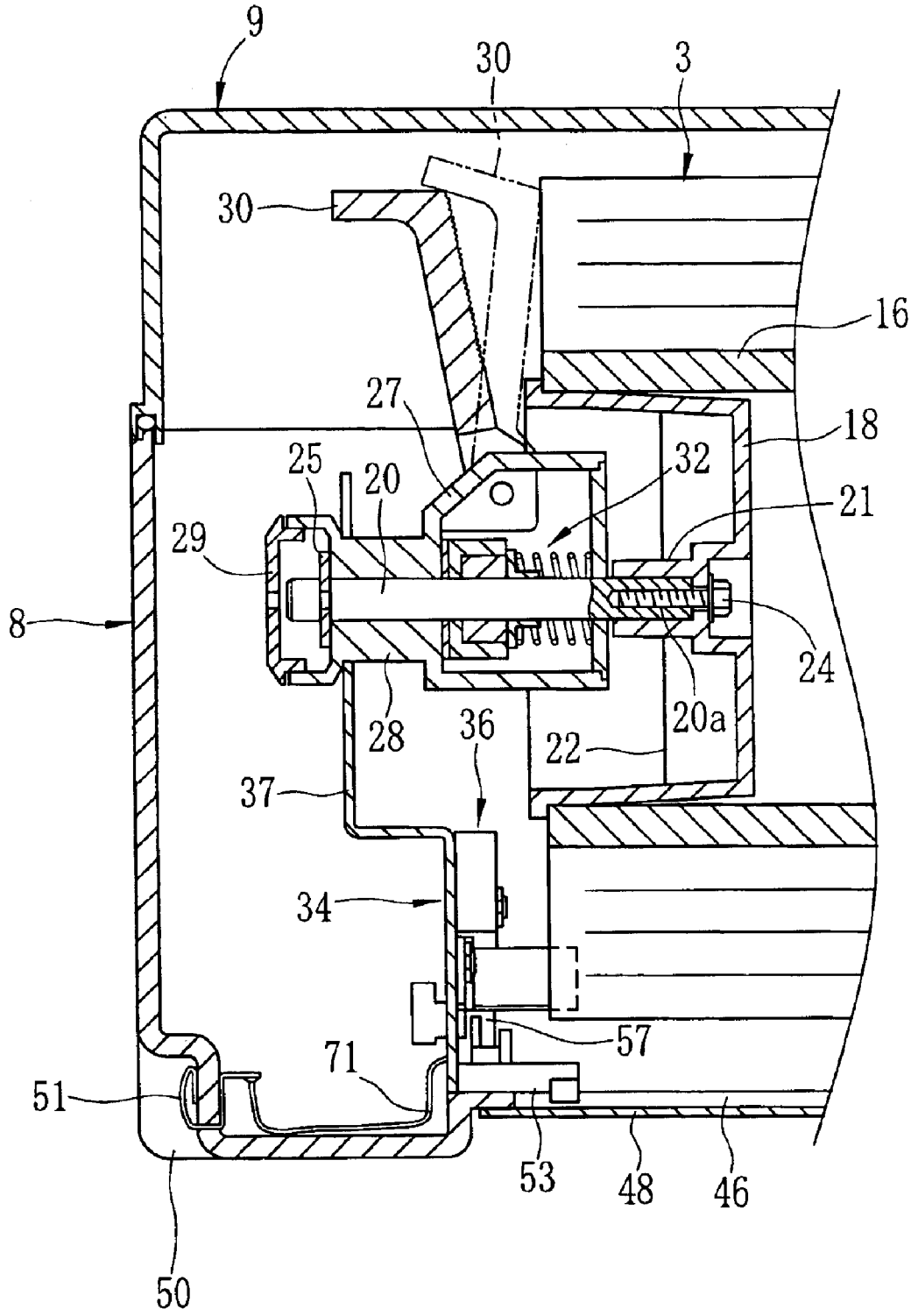
FIG. 6 is a fragmentary sectional view of the paper magazine along its axial direction, illustrating an axial section of the paper holder.

As shown in FIGS. 5 and 6, the core portion 19 is substantially cylindrical and has an outer diameter that permits force-fitting the core portion 19 into the spool 16. A flange 18*a* is formed around a trailing end of the core portion 19 in an inserting direction into the spool 16. The flange 18*a* comes into contact with the end face of the spool 16 and positions the 15 in an axial direction of the spool 16. A bearing sleeve 21 is provided along a rotary axis of the core portion 18, and is connected to an internal periphery of the core portion 18 through four ribs 22 which are spaced from each other at an interval of 90 degrees. An iron rotary axle 20 is inserted into the bearing sleeve 21.

A screw thread 20*a* is formed in a leading end of the rotary axle 20 in the inserting direction. After the rotary axle 20 is inserted into the bearing sleeve 21, a screw bolt 24 is connected to the leading end of the rotary axle 20 through the screw thread 20*a*, securing the core portion 18 to the leading end of the rotary axle 20. A trailing end of the rotary axle 20 is rotatably inserted into the bearing portion 19, and an E-ring 25 is force-fitted on the trailing end of the rotary axle 20, for stopping the rotary axle 20 from slipping off the bearing portion 19. According to this configuration, the core portion 18 and the recording paper roll 2 rotate together with the rotary axle 20.

The bearing portion 19 consists of a casing member 27, a sleeve portion 28 formed integrally with the casing member 27, a cap 29 that is fitted to an outer end of the sleeve portion 28, and a handle 30 that is pivotally mounted to the casing member 27. The handle 30 has a substantially L-shaped sectional contour, and is held by hand to lift the recording paper roll 3. The handle 30 is in a released position as shown by solid lines in FIG. 6 when the 15 is attached to the recording paper roll 3. By lifting the recording paper roll 3 while holding the handles 30, the handles 30 swing into contact with end faces of the recording paper roll 3 because of the lifting operation and the weight of the recording paper roll 3. Therefore, the recording paper roll 3 is prevented from being unwound, and the end faces of the recording paper roll 3 are maintained neat, while the recording paper roll 3 is carried into the paper magazine 7.

Inside the casing member 27 is provided a load switching mechanism 32 that rises rotational load on the recording paper roll 3 while the recording paper 2 is fed out from the paper magazine 7, and lowers the rotational load on the recording paper roll 3 while the recording paper 2 is rewound into the paper magazine 7. The load switching mechanism 32 applies a backward tension on the recording paper 2 as it is conveyed, and thus improves stability in conveying the recording paper 2. Thereby, the recording paper 2 is prevented from getting skewed or jammed in the printer. While the recording paper 2 is being rewound into the paper magazine 7, the load switching mechanism 32 eliminates invariance in rotation between the center portion and the outer convolution of the recording paper roll 3.

As shown in FIGS. 3, 5 and 6, the magazine body 8 has a supporting frame 34 for supporting the paper holders 15, a paper supply roller 35, and a pre-cut memory mechanism 36 therein. The supporting frame 34 is formed by blanking and bending a thin metal plate, and consists of a pair of side holder plates 37 and 38 and securing portions 39 for securing the supporting frame 34 to the inside of the magazine body 8. The side holder plates 37 and 38 have slits 37*a* and 38*a* that accept the sleeves 28 of the paper holders 15 when the recording paper roll 3 held by the paper holders 15 is inserted in the magazine body 8. Each slit 37*a* and 38*a* consists of an upper vertical section and a lower oblique section. The upper vertical section permits inserting the recording paper roll 3 from upside into the magazine body 8, whereas the oblique section guides the recording paper roll 3 toward the paper supply roller 35. The recording paper roll 3 slides down along the slits 37*a* and 38*a* as the recording paper 2 is withdrawn and the diameter of the recording paper roll 3 decreases, so the outermost convolution of the recording paper roll 3 is kept in contact with the paper supply roller 35.

The paper supply roller 35 consists of a rotary shaft 41 and a roller portion 42. The rotary shaft 41 is rotatably mounted to the supporting frame 34. The roller portion 42 is mounted on the rotary shaft 41, and is formed from a material whose frictional power is strong, like rubber. One end of the rotary shaft 41 is protruded out of the magazine body 8, and a drive gear 44 is secured to the protruded one end. The drive gear 44 is placed in a recess 43 that is formed in one side of the magazine body 8. The drive gear 44 is coupled to an output gear 75 (see FIG. 1) of a paper conveying mechanism of the printer when the paper magazine 7 is loaded in the magazine chamber 5 of the printer. Thereby, the paper supply roller 35 is rotated by the paper conveying mechanism.

As shown in FIG. 5, the recording paper 2 is fed out through a paper port 46 that is formed on a bottom side of the magazine body 8. The paper port 46 is usually closed by a door plate 48 that is urged in the closed position. After the paper magazine 7 is loaded in the printer, the door plate 48 is opened by a door operating mechanism 77 (see FIG. 1) of the printer.

Referring back to FIG. 3, a magazine connector 50 is provided on the same side of the magazine body 8 as the drive gear 44. The magazine connector 50 is provided with a plurality of contacts 51 that is formed from bent metal strips, as shown in FIG. 6. The magazine connector 50 is connected to a printer connector 76 (see FIG. 1) when the paper magazine 7 is loaded in the magazine chamber 5.

Figure 7:
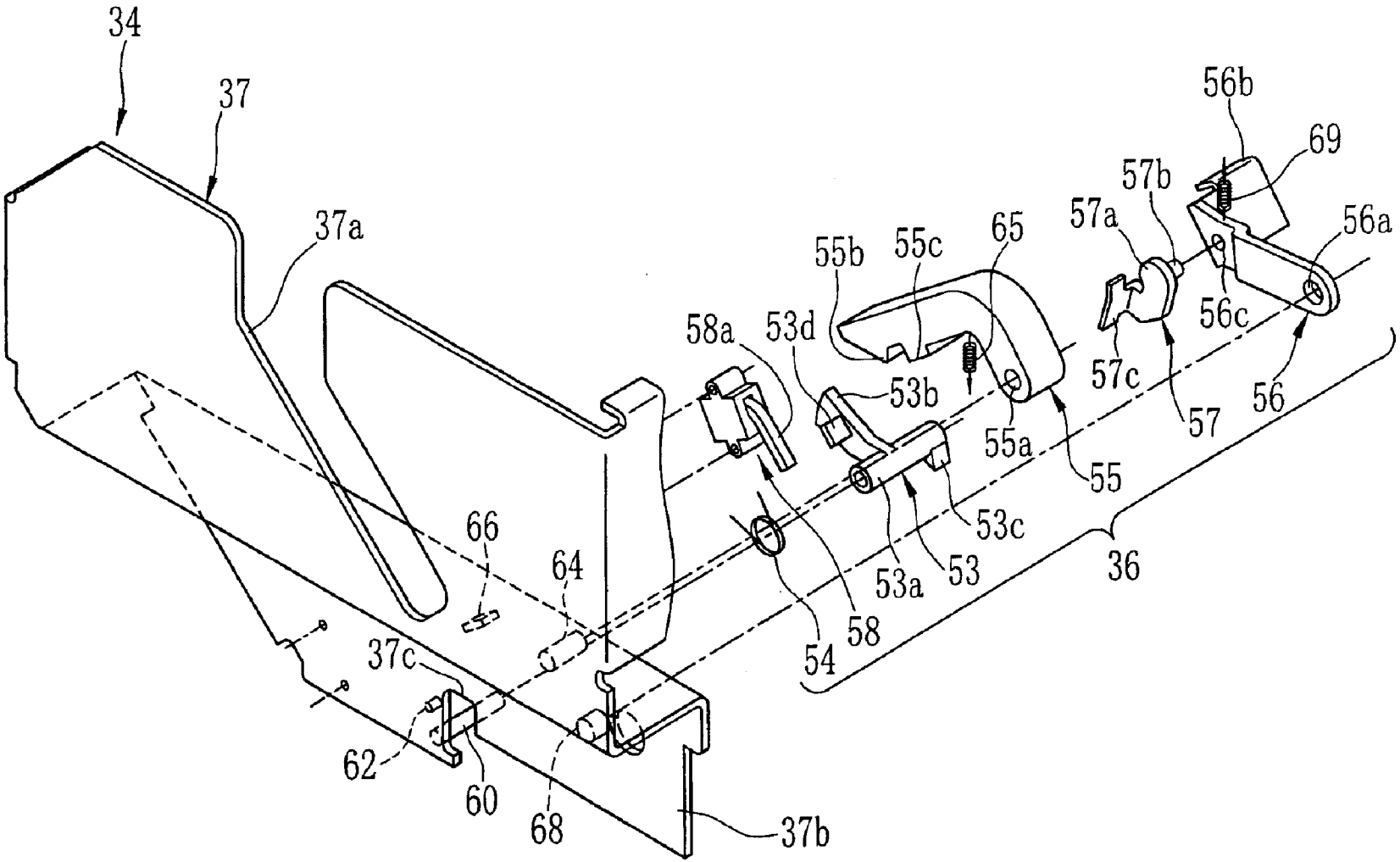
FIG. 7 is an exploded perspective view of a pre-cut memory mechanism provided in the paper magazine.
Figure 8:
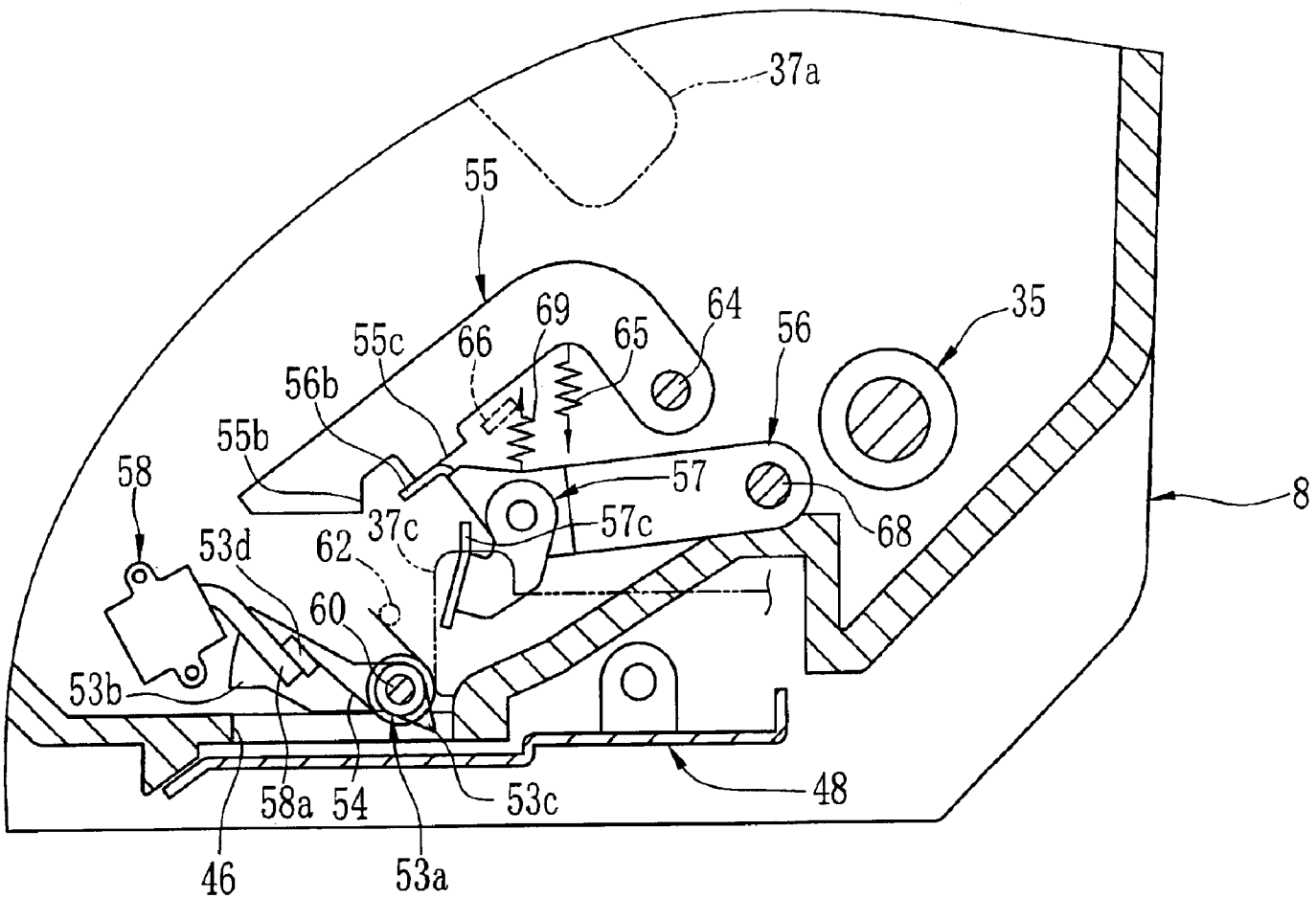
FIG. 8 is an explanatory diagram illustrating a condition of the pre-cut memory mechanism, where any recording paper roll is not contained in the paper magazine.

As shown in FIGS. 7 and 8, the pre-cut memory mechanism 36 is mounted inside the side holder plate 37 of the supporting frame 34. The side holder plate 37 has an offset portion 37*b* below the slit 37*a*. The offset portion 37*b* is shifted inward of the magazine body 8 from the upper portion of the side holder plate 37 where the slit 37*a* is provided. The pre-cut memory mechanism 36 is mounted to the offset portion 37*b*. The pre-cut memory mechanism 36 is constituted of a pre-cut detection lever 53, a coiled spring 54, a holding lever 55, a reset lever 56, a limiting lever 57 and a pre-cut detection switch 58.

The pre-cut detection lever 53 consists of a pivot sleeve 53*a*, a locking blade 53*b* and a detective projection 53*c*. The pivot sleeve 53*a* is rotatably fitted on a pin 60 that is formed on the side holder plate 37. The locking blade 53*b* and the detective projection 53*c* protrude radially outward from the pivot sleeve 53*a*. The pre-cut detection lever 53 may rotate between a first or laid position where the locking blade 53*b* is laid down onto the pre-cut detection switch 58, and a second or erected position where the locking blade 53*b* is erected.

When the pre-cut detection lever 53 is in the laid position, as shown in FIG. 8, a pushing projection 53*d* on the locking blade 53*b* pushes an actuation strip 58*a* of the pre-cut detection switch 58, and the detective projection 53*c* is protruded into the paper port 46. In this position, the detective projection 53*c* is pushed by a leading end of the recording paper 2 as it is advanced out through the paper port 46. As a result, the pre-cut detection lever 53 is rotated into the erected position, and the detective projection 53*c* is retracted from the paper port 46.

The coiled spring 54 is inserted into the pivot sleeve 53*a*, and is suspended between the pushing projection 53*d* and a projection 62 that is provided on the side holder plate 37. The coiled spring 54 thus urges the pre-cut detection lever 53 to rotate in a counterclockwise direction in FIG. 7 toward the laid position. The force of the coiled spring 54 is so weak that the pre-cut detection lever 53 is rotated into the erected position by the advancing recording paper 2.

Figure 9:
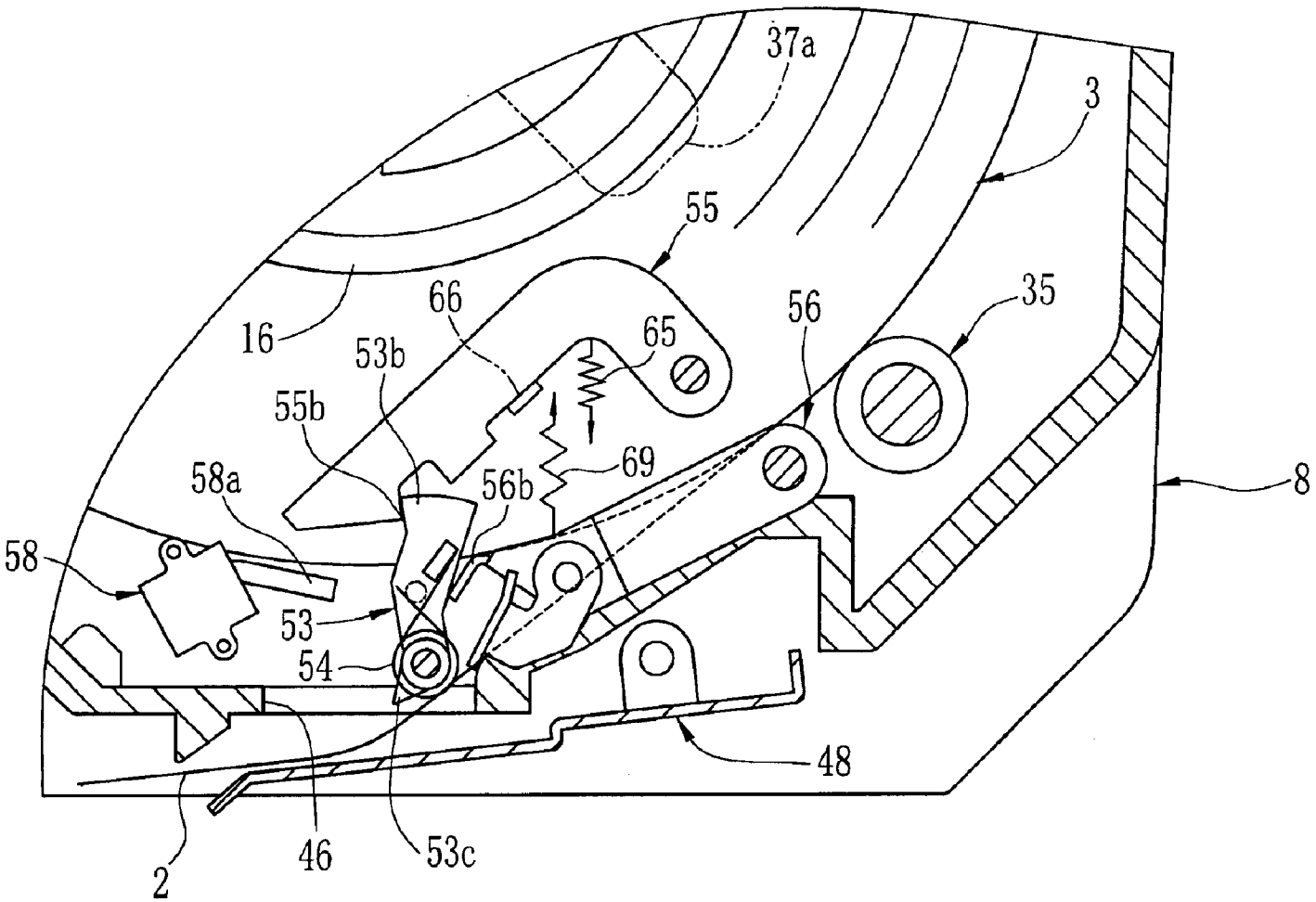
FIG. 9 is an explanatory diagram illustrating a condition of the pre-cut memory mechanism, where the recording paper is fed out of the paper magazine.

The holding lever 55 is a crank-shaped lever and is pivotal about a pin 64 that is provided on the side holder plate 37. The pin 64 is inserted into a hole 55*a* that is formed through a short arm of the holding lever 55, whereas a locking claw 55*b* and a projection 55*c* are formed in a long arm of the holding lever 55. A spring 65 is coupled to an inside corner of the holding lever 55 to urge the holding lever 55 to rotate in the counterclockwise direction toward a locking position. A stop plate 66 for stopping the holding lever 55 at the locking position is provided on the side holder plate 37 in proximity to the pin 64. When the holding lever 55 is in the locking position, a distal end of the holding lever 55 is pushed by the pre-cut detection lever 53 as rotating toward the erected position, so the holding lever 55 rotates a little in the clockwise direction against the force of the spring 65. When the pre-cut detection lever 53 reaches the erected position, the locking blade 53*b* of the pre-cut detection lever 53 is engaged with the clocking claw 55*b* of the holding lever 55, thereby the pre-cut detection lever 53 is held in the erected position against the force of the coiled spring 54, as shown in FIG. 9.

The reset lever 56 is also a crank-shaped lever, and is pivoted on a pin 68 of the side holder plate 37 through a hole 56*a* that is provided through a long arm of the reset lever 56. The reset lever 56 is urged by a spring 69 to rotate in the clockwise direction in the drawing, so that a push-up projection 56*b* formed integrally with a short arm of the reset lever 56 pushes up the projection 55*c* of the holding lever 55 toward an unlock position where the engagement between the locking claw 55*b* of the holding lever 55 and the pre-cut detection lever 53 is released, and the pre-cut detection lever 53 rotates to the laid position according to the force of the coiled spring 54, as shown in FIG. 8.

Figure 10:
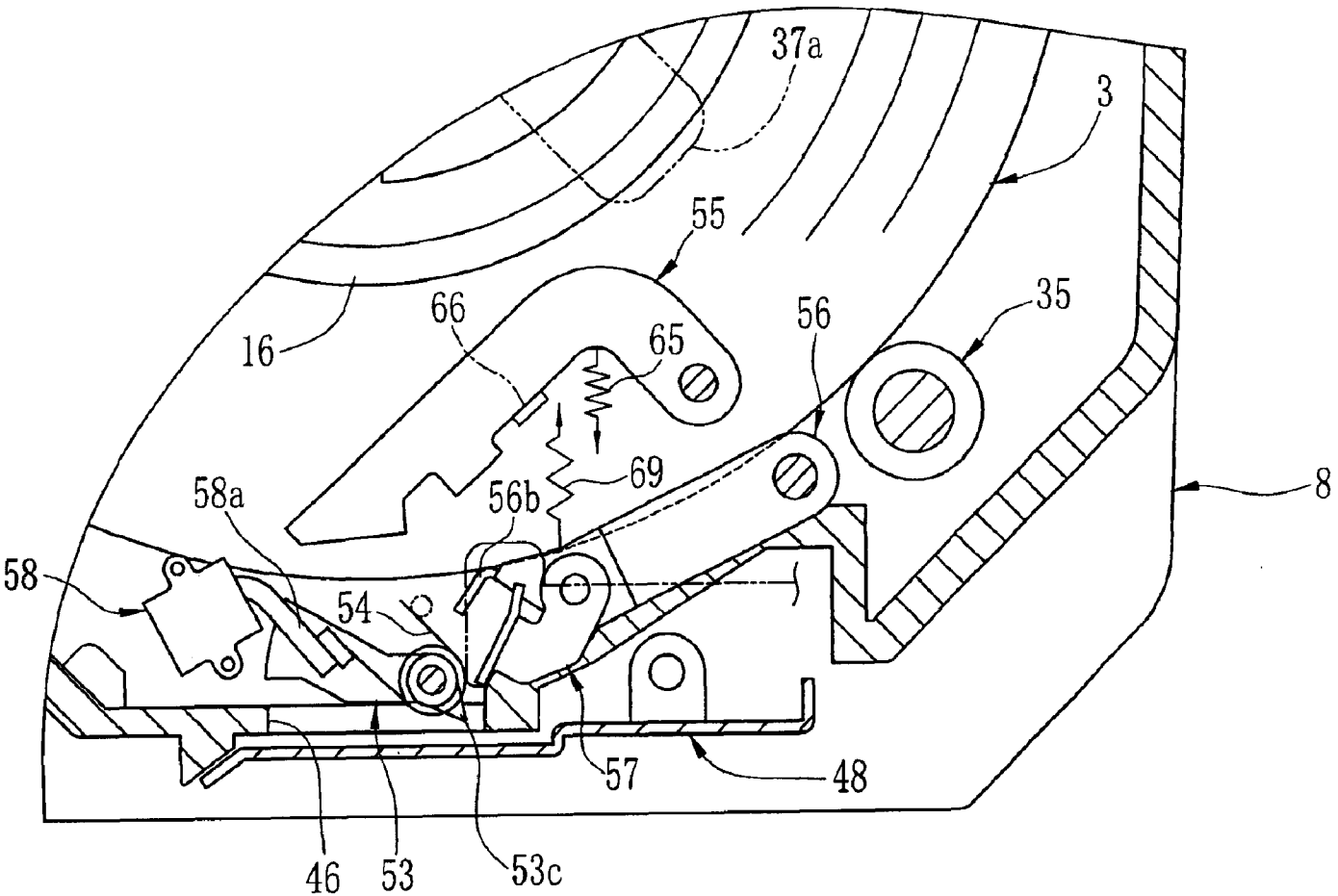
FIG. 10 is an explanatory diagram illustrating a condition of the pre-cut memory mechanism, where the recording paper roll is newly loaded and is not yet fed out of the paper magazine.
Figure 11:
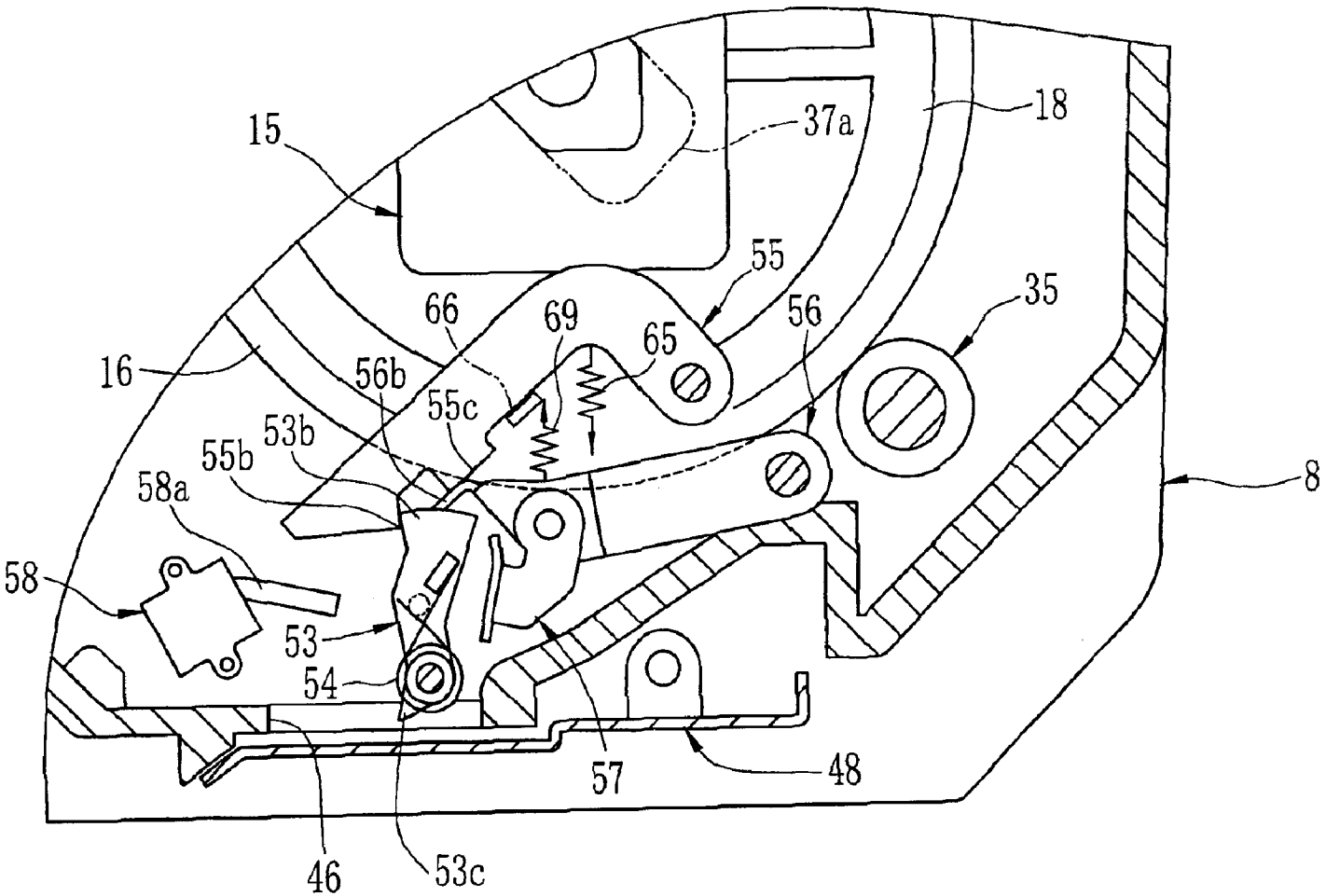
FIG. 11 is an explanatory diagram illustrating a condition of the pre-cut memory mechanism, where the recording paper of the recording paper roll is used up.

However, as shown in FIG. 10, the push-up projection 56*b* of the reset lever 56 is pushed away from the holding lever 55 by the recording paper roll 3 when the recording paper roll 3 is placed in the paper magazine 7. The reset lever 56 rotates toward the holding lever 55 as the diameter of the recording paper roll 3 decreases with the consumption of the recording paper 2, according to the force of the spring 69. When the recording paper roll 3 is removed from the paper magazine 7, the reset lever 56 pushes up the projection 55*c* of the holding lever 55, resetting the pre-cut detection lever 53 to the laid position. Even when the recording paper 2 of the recording paper roll 3 is used up, so long as the spool 16 remains in the paper magazine 7, the reset lever 56 does not disengage the holding lever 55 from the pre-cut detection lever 53, as shown in FIG. 11, because the spool 16 slides down to the bottom of the slits 37*a* and 38*a*, and pushes the push-up projection 56*b* of the reset lever 56.

The long arm of the reset lever 56 has a stepped portion with a hole 56*c* for mounting the limiting lever 57. The limiting lever 57 has a pin 57*b* on its mounting portion 57*a*, and the pin 57*b* is inserted in the hole 56*c* of the reset lever 56, such that the limiting lever 57 is pivotal about the pin 57*b*. A limiting arm 57*c* of the limiting lever 57 is inserted in a notch 37*c* of the side holder plate 37 on the way the reset lever 56 pushes up the holding lever 55. Thus, the limiting lever 57 stops the reset lever 56 from rotating more than necessary.

Although they are omitted from the drawings for the sake of avoiding complication, E-rings are force-fitted on the pins 60, 64 and 68 of the side holder plate 37 and the pin 57*b* of the limiting lever 57, as securing members.

The pre-cut detection switch 58 is a conventional micro switch, and is secured to the side holder plate 37 by screws. When the actuation strip 58*a* of the pre-cut detection switch 58 is pushed by the pre-cut detection lever 53, the pre-cut detection switch 58 is turned on to output a detection signal. When the actuation strip 58*a* is released from the pre-cut detection lever 53, the pre-cut detection switch 58 is turned off. As shown in FIG. 6, the pre-cut detection switch 58 is connected to the contact 51 of the magazine connector 50 through wiring codes 71, so the pre-cut detection switch 58 is connected to the printer when the paper magazine 7 is loaded in the magazine chamber 5.

Referring back to the printer shown in FIG. 1, the magazine chamber 5 is provided with a magazine detection switch 73, a magazine chamber lid detection switch 74, the output gear 75, the printer connector 76 and the door operating mechanism 77. The magazine detection switch 73 outputs a detection signal to a controller 78 when the paper magazine 7 is placed in the magazine chamber 5. The magazine chamber lid detection switch 74 detects if a not-shown magazine lid is open or closed, and outputs a detection signal to the controller 78 when the magazine chamber lid is open. The controller 78 is constituted of CPU, program ROM, work RAM and so force, and controls the respective components of the printer.

The output gear 75 meshes with the drive gear 44 of the paper magazine 7 when the paper magazine 7 is loaded. The output gear 75 is rotated by a motor 80. The motor 80 is driven to rotate in a forward direction to rotate the paper supply roller 35 in a paper supply direction, or in a rearward direction to rotate the paper supply roller 35 in the rewinding directions.

The printer connector 76 is provided with a plurality of contacts which come to contact with the contacts of the magazine connector 50. The contacts of the printer connector 76 are connected to the controller 78, so the pre-cut detection switch 58 in the paper magazine 7 is connected to the controller 78. The door operating mechanism 77 is constituted of a solenoid and cam members, and causes the door plate 48 of the paper magazine 7 to swing open or close the paper port 46.

A pair of feed rollers 83 are disposed behind the paper port 46 in the paper supply direction of the recording paper 2. The feed rollers 83 consists of a capstan roller 84 that is driven by the motor 80, and a pinch roller 85 that is pressed onto the capstan roller 84 by a not-shown mechanism consisting of a solenoid and cam members. The recording paper 2 is pinched between the capstan roller 84 and the pinch roller 85, and is conveyed in an advancing direction that is equal to the paper supply direction, and a printing direction that is reverse to the advancing direction, as the capstan roller 84 is rotated in corresponding directions. The number of rotations of the pinch roller 85 is counted to calculate the conveyed amount of the recording paper 2 from the rotational number.

A thermal head 87 is disposed behind the feed roller pair 83 in the advancing direction. A heating element array 87*a* consisting of a large number of heating elements aligned across the width of the recording paper 2 is provided on a surface of the thermal head 87 that faces the recording paper 2. A platen roller 88 is disposed in opposition to the heating element array 87*a*. The platen roller 88 is movable up and down, and is urged upward by a not-show spring, to contact with the heating element array 87*a*.

The platen roller 88 moves up to press the recording paper 2 onto the thermal head 87 as the recording paper 2 is conveyed in the printing direction through the feed roller pair 83. The thermal head 87 heats the heating element array 87*a* up to those temperatures determined according to print data, to develop colors on the respective coloring layers of the recording paper 2. The platen roller 88 rotates following the movement of the recording paper 2 in the printing direction, and is moved downward away from the thermal head 87 while the recording paper 2 is being fed out from the paper magazine 7, or ejected from the printer.

Behind the thermal head 87 in the advancing direction, there are disposed a yellow optical fixing device 90 and a magenta optical fixing device 91. These fixing devices 90 and 91 are each constituted of an ultraviolet lamp and a reflector. The ultraviolet lamp of the yellow fixing device 90 emits near-ultraviolet rays having an emission peak at 420 nm, for fixing the yellow coloring layer of the recording paper 2. The ultraviolet lamp of the magenta fixing device 91 emits ultraviolet rays having an emission peak at 365 nm, for fixing the magenta coloring layer of the recording paper 2.

A cutter 95 is disposed between the thermal head 87 and the magenta fixing device 91, to cut a portion of the recording paper 2 having an image printed thereon. A pair of ejection rollers 93 are disposed at an exit 94, to eject the cut recording paper 2 out of the printer through the exit 94. An upper knife 95*a* of the cutter 95 is moved up and down by a cutter drive mechanism 96 that is constituted of a solenoid and cam members.

Although it is not shown for clarity sake, the printer is provided with guide members for guiding the recording paper 2 through from the magazine chamber 5, between the feed roller pair 83, between the thermal head 87 and the platen roller 88, under the optical fixing devices 90 and 91 to the exit 94.

A leading end detector 97 is disposed between the feed roller pair 85 and the thermal head 87, to detect the leading end of the recording paper 2. The leading end detector 97 may be a reflective photo sensor, and outputs a detection signal to the controller 78 when the leading end of the recording paper 2 goes through between the capstan roller 84 and the pinch roller 85. In response to the detection signal from the leading end detector 97, the controller 78 moves the pinch roller 85 down to the capstan roller 84.

Figure 12:
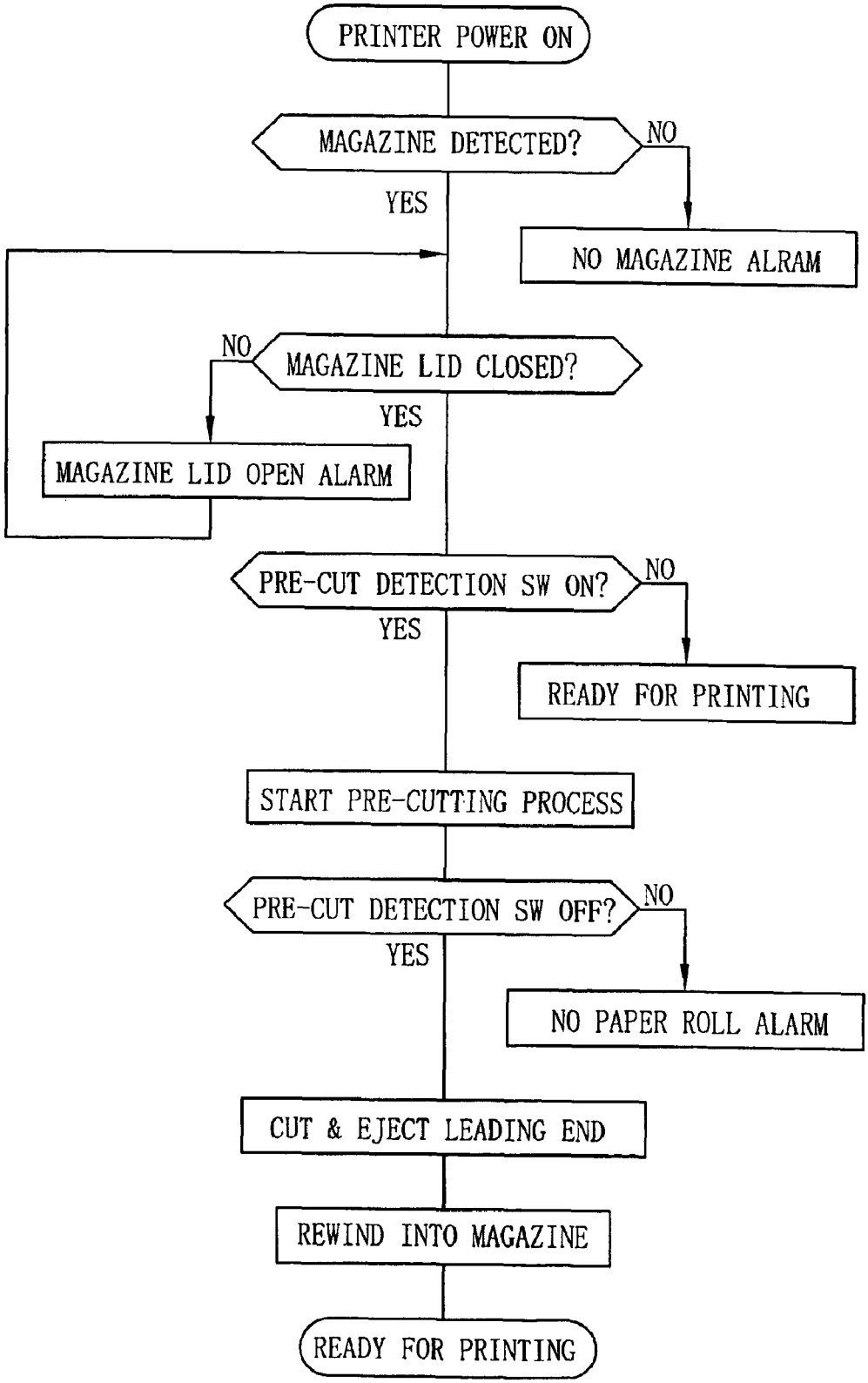
FIG. 12 is a flow chart illustrating a pre-cutting process of the thermosensitive color printer.

Now, the operation of the present embodiment will be described with reference to the flowchart of FIG. 12.

First, the recording paper roll 3 is removed from the light-tight box or bag, and the paper holders 15 are force-fitted in the opposite ends of the spool 16 of the recording paper roll 3. The locking members 12 is unlocked from the magazine lid 9, and the magazine lid 9 is turned about the hinge 11 to open the top side of the magazine body 8, as shown in FIG. 3.

Before the recording paper roll 3 is not placed in the paper magazine 7, the pre-cut memory mechanism 36 is in the condition as shown in FIG. 8, where the reset lever 56 is located at its reset position according to the force of the spring 69, so the push-up projection 56*b* pushes up the projection 55*c* of the holding lever 55 to the release position against the force of the spring 65. Therefore, the pre-cut detection lever 53 is in the laid position according to the force of the spring 54, and thus turns on the pre-cut detection switch 58. Since the limiting lever 57 is engaged in the notch 37*c* of the side holder plate 37, the reset lever 56 and the holding lever 55.

To place the recording paper roll 3 in the magazine body 8, the user grips the handles 30 of the paper holders 15 attached to the recording paper roll 3, so the recording paper roll 3 may be carried about without being touched by hands. When the recording paper roll 3 is lifted while gripping the handles 30, the handles 30 are turned into tight contact with the face ends of the recording paper roll 3, because of the weight of the recording paper roll 3. Thereby, the recording paper roll 3 is prevented from being unwound, and its face ends are aligned. Then, the sleeve portions 28 of the paper holders 15 holding the recording paper roll 3 are inserted into the slits 37*a* and 38*a* of the supporting frame 34. Then, the recording paper roll 3 slides down along the slits 37*a* and 38*a*, and comes to contact with the paper supply roller 35, because of its own weight. The handles 30 are turned open by its own weight.

After the recording paper roll 3 is placed in the magazine body 8, the magazine lid 9 is closed and locked by the locking members 12. In this condition, the push-up arm 56*b* of the reset lever 56 is pressed by the recording paper roll 3, so the reset lever 56 is turned away from the holding lever 55 against the force of the spring 69, as shown in FIG. 10. So the holding lever 55 swings according to the force of the spring 65, and is stopped at the locking position by the stopping plate 66.

By loading the paper magazine 7 with the recording paper roll 3 in the magazine chamber 5 of the printer, as shown in FIG. 1, the output gear 75 of the printer is interlocked with the drive gear 44 of the paper magazine 7. Also, the magazine connector 50 is connected to the printer connector 76, so the pre-cut detection switch 58 is connected to the controller 78. Loading of the paper magazine 7 is completed by closing the magazine chamber lid.

When a power source of the printer is turned on, the controller 78 checks the detection signal from the magazine detection switch 73. If the magazine detection switch 73 is not turned on, an alarming display and an alarming sound are given to notice the user that the paper magazine 7 is not properly loaded in the magazine chamber 5. If the magazine detection switch 73 is turned on, the controller 78 checks the condition of the magazine chamber lid detection switch 74. If the magazine chamber lid detection switch 74 is off, the controller 78 gives an alarming display and an alarming sound to notice the user that the magazine chamber lid is open, and interrupts the process. The controller 78 restarts processing after the magazine chamber lid is closed.

Thereafter, the switching condition of the pre-cut detection switch 58 of the paper magazine 7 is checked. If the recording paper roll 3 of the loaded paper magazine 7 is new and the recording paper 2 has not yet been withdrawn from the recording paper roll 3, the pre-cut detection switch 58 is ON, as shown in FIG. 10. Accordingly, if the controller 78 receives an ON signal from the pre-cut detection switch 58 through the connection between the magazine connector 50 and the printer connector 76, the controller 78 starts a pre-cutting process after actuating the door opening mechanism 77 to open the paper port 46 of the paper magazine 7. Thus, the ON signal from the pre-cut detection switch 58 is served as pre-cut data representing that the pre-cutting process has not been executed on the loaded recording paper roll 3.

In the pre-cutting process, the motor 80 is driven through the motor driver 81 to rotate in the forward direction. The forward rotation of the motor 80 is transmitted to the paper supply roller 35 of the paper magazine 7 through the output gear 75 and the drive gear 44, causing the recording paper roll 3 to rotate in the clockwise direction in the drawings. Then, the leading end of the recording paper 2 is fed out of the paper magazine 7 through the paper port 46, while pushing the detective projection 53*c* of the pre-cut detection lever 53 to rotate the pre-cut detection lever 53 to the erected position against the force of the coiled spring 54. The pre-cut detection lever 53 rotates to the erected position while pushing the holding lever 55 at its locking blade 53*b*. When the pre-cut detection lever 53 reaches the erected position, the locking blade 53*b* is placed in a recess between the engaging claw 55*b* and the projection 55*c* of the holding lever 55, so the holding lever 55 rotates into the locking position according to the force of the spring 65. In the locking position, the engaging claw 55*b* is engaged with the locking blade 53*b*, so the pre-cut detection lever 53 is held at the erected position, as shown in FIG. 9. Thereby, the actuation strip 58*a* of the pre-cut detection switch 58 is released from the pressure by the pushing projection 53*d*, so the pre-cut detection switch 58 is turned OFF. The pre-cut detection lever 53 is held at the erected position by the holding lever 55 insofar as the recording paper roll 3 is removed from the paper magazine 7.

The controller 78 measures time from the start of paper feed-out operation for the pre-cutting process, to the time when the pre-cut detection switch 58 is turned off. If the measured time is beyond a predetermined value, the controller 78 judges that there is no paper roll 3 in the paper magazine 7, and gives an alarm to the user.

The recording paper 2 is conveyed in the paper supply direction from the paper magazine 7 along the not-shown guide members into between the pinch roller 85 and the capstan roller 84 of the feed roller pair 83. When the leading end of the recording paper 2 goes past the feed roller pair 83, the leading end detector 97 detects the leading end, and outputs a detection signal to the controller 78. Upon receipt of the detection signal from the leading end detector 97, the controller 78 stops driving the motor 80, and presses the pinch roller 85 onto the capstan roller 84, to pinch the recording paper 2 between the feed roller pair 83. Thereafter, the controller 78 drives the motor 80 to rotate in the forward direction, to feed the recording paper 2 in the paper supply direction.

When the leading end of the recording paper 2 is fed into between the ejection roller pair 93, the controller 78 stops driving the motor 80, and nips the recording paper 2 between the ejection roller pair 93. Concurrently with nipping by the ejection roller pair 93, the controller 78 activates the cutter driving mechanism 96 to cut the recording paper 2 by the cutter 95, to provide a neatly cut leading edge. After cutting the recording paper 2, the controller 78 rotates the motor 80 in the forward direction to eject the cut portion of the recording paper 2 from the exit 94 of the printer. Thereafter, the motor 80 is rotated in the reverse direction to rewind the recording paper 2 into the paper magazine 7, thereby completing the pre-cutting process for the unused recording paper roll 3. Since the pre-cut detection switch 58 is maintained OFF even after the recording paper 2 is rewound into the paper magazine 7, it is possible to determine based on the switching condition of the pre-cut detection switch 58 whether the contained recording paper roll 3 has gone through the pre-cutting process or not.

When a print starting operation is effected on the printer, the motor 80 is rotated forward to feed out the recording paper 2 from the paper magazine 7. When the leading end detector 97 detects the neatly cut leading edge of the recording paper 2, the controller 78 activates the pinch roller 85 to nip the recording paper 2 by the feed roller pair 83, and rotates the capstan roller 84 to feed the recording paper 2 in the advancing direction. The recording paper 2 is conveyed in the advancing direction till the rotational number of the pinch roller 85 reaches a predetermined count value. Then, the controller 78 stops driving the motor 80. In this position, the leading edge of the recording paper 2 is placed a predetermined amount behind the thermal head 87 in the advancing direction. Then, the controller 78 deactivates a cam mechanism or a solenoid that holds the platen roller 88 in a retracted position from the thermal head 87, so the platen roller 88 moves up according to the force of the not-shown spring, pressing the recording paper 2 onto the heating element array 87*a* of the thermal head 87.

Then, the controller 78 drives the motor 80 to rotate reversely to rotate the paper supply roller 35 and the feed roller pair 83 in the printing direction. When an end of an image recording area of the recording paper 2 reaches the heating element array 87*a* of the thermal head 87 while the recording paper 2 is being conveyed in the printing direction, the heating element array 87*a* begins to heat the recording paper 2, thereby to record an yellow frame of a full-color image line after line on the yellow coloring layer in the image recording area.

When the thermal recording of the yellow frame in the image recording area is completed, the controller 78 stops the motor 80 and drives the cam or the solenoid to remove the platen roller 88 away from the thermal head 87. The motor 80 is rotated forward again, to feed the recording paper 2 in the advancing direction again. With the start of feeding in the advancing direction, the ultraviolet lamp of the yellow fixing device 90 is turned on to fix the yellow coloring layer in the image recording area having the yellow frame recorded thereon.

When the optical fixing of the yellow coloring layer in the image recording area is completed, the controller 78 stops the motor 80 and deactivates the cam or the solenoid to let the platen roller 88 move up and nip the recording paper 2 between the thermal head 87. The controller 78 rotates the motor 80 and thus the feed roller pair 83 to feed the recording paper 2 in the printing direction. When the image recording area reaches the heating element array 87*a*, the heating element array 87*a* starts heating the recording paper 2 to record a magenta frame of the full-color image line by line on the magenta recording layer in the same image recording area.

When the thermal recording of the magenta frame in the image recording area is completed, the controller 78 stops the motor 80 and drives the cam or the solenoid to remove the platen roller 88 away from the thermal head 87. The motor 80 is rotated forward again, to feed the recording paper 2 in the advancing direction again. With the start of feeding in the advancing direction, the ultraviolet lamp of the magenta fixing device 91 is turned on to fix the magenta coloring layer in the image recording area having the magenta frame recorded thereon.

When the optical fixing of the yellow coloring layer in the image recording area is completed, the controller 78 stops the motor 80 and deactivates the cam or the solenoid to let the platen roller 88 move up and nip the recording paper 2 between the thermal head 87. The controller 78 rotates the motor 80 and thus the feed roller pair 83 to feed the recording paper 2 in the printing direction. When the image recording area reaches the heating element array 87*a*, the heating element array 87*a* starts heating the recording paper 2 to record a cyan frame of the full-color image line by line on the cyan recording layer in the same image recording area.

When the thermal recording of the cyan frame in the image recording area is completed, the controller 78 stops the motor 80 and drives the cam or the solenoid to remove the platen roller 88 away from the thermal head 87. The motor 80 is rotated forward again, to feed the recording paper 2 in the advancing direction again. Since the cyan coloring layer will not color under normal preservative conditions, the cyan coloring layer is not optically fixed.

Next, the controller 78 drives the cutter 95 while stopping the motor 80, to cut the image recording area with the full-color image recorded thereon off the recording paper roll 3. Then the motor 80 is rotated forward to rotate the ejection roller pair 93 to feed the cut portion out of the printer through the exit 94. If there is not an image to print successively, the recording paper 2 is wound back into the paper magazine 7, for the sake of moisture protection. For printing an image on the recording paper 2 again, the paper supply roller 35 is rotated to feed out the recording paper 2 from the paper magazine 7. Thereafter, the image is printed in the same way as for the first image.

While the recording paper 2 is completely wound back into the paper magazine 7, it is possible to unload the paper magazine 7 and load another paper magazine 7 of the same structure but containing a roll of different kind of recording paper, e.g. paper for stickers. If the recording paper of the replacing paper magazine 7 is already subjected to the pre-cutting process, the pre-cut detection lever 53 of the pre-cut memory mechanism 36 of that paper magazine 7 is held in the erected position by the holding lever 55, so the pre-cut detection switch 58 of the pre-cut memory mechanism 36 is in the OFF position. Therefore, the controller 78 does not execute the pre-cutting process, and starts the printing process as soon as the print starting operation is made.

Although the pre-cut memory mechanism 36 is provided as a pre-cut memory device in the above embodiment, an electronic memory may be mounted as a pre-cut memory device in a paper magazine. The memory is connected to the controller 78 by connecting a magazine connector to the printer connector 76, so the controller 78 writes pre-cut data in the memory after the pre-cutting process is executed on a recording paper roll contained in the paper magazine. When the printer is turned on, the controller 78 reads the pre-cut data from the memory, and executes the pre-cutting process if the pre-cut data is not written in the memory. In that case, it is preferable to provide the paper magazine with a switch for detecting the recording paper roll 3 or the spool 16, a data deleting circuit for deleting the data from the memory when the recording paper roll 3 or the spool 16 is removed from the paper magazine 7, and a power source for supplying the memory and the data deleting circuit. This configuration ensures executing the pre-cutting process only when the loaded paper magazine 7 contains a new roll of recording paper.

In the above embodiment, whether the pre-cutting process has been made on the loaded recording paper or not is determined when the printer is turned on. However, it is possible to provide the printer with an operation switch for making the pre-cutting process at appropriate times, and execute the judgement only when this operation switch is operated. In that case, the pre-cutting process is executed only when it is judged that the loaded recording paper has not yet been subjected to the pre-cutting process.

Although the printer of the above embodiment is loaded with the paper magazine, the present invention is applicable to a printer where the recording paper roll is directly loaded in a paper supply chamber. In that case, a pre-cut memory device is mounted in the paper supply chamber.

The present invention is not only applicable to thermosensitive type printers, but also applicable to any kinds of those printers which are loaded with a rolled recording paper.

Thus, the present invention is not to be limited to the above embodiments but, on the contrary, various modification will be possible to those skilled in the art without departing from the scope of appended claims.

What is claimed is:

1. A printer loaded with a roll of recording paper, comprising:

a paper supply device for feeding out the recording paper from the loaded roll;

a cutting device for cutting the fed out recording paper at appropriate lengths;

a control device for controlling a pre-cutting process whereby a leading end of the recording paper is cut at a predetermined length by said cutting device and is ejected from the printer before an image is printed on the recording paper; and a pre-cut memory device, said pre-cut memory device storing pre-cut data of a first value representing that the loaded recording paper has not gone through the pre-cutting process or pre-cut data of a second value representing that the loaded recording paper has gone through the pre-cutting process, wherein said control device refers to said pre-cut memory device and executes said pre-cutting process only when the pre-cut data has the first value, wherein said pre-cut memory device stores said pre-cut data of the first value when the roll of recording paper or a spool of the roll is unloaded.

2. A printer as recited in claim 1, wherein the roll of recording paper is contained in a paper magazine that is removably loaded in the printer, and said pre-cut memory device is provided in the paper magazine and is connected to said control device when said paper magazine is loaded in the printer.

3. A printer as recited in claim 2, wherein said pre-cut memory device comprises:

a pre-cut detection member that is located in a first position before the roll of recording paper is loaded, and is moved to a second position in cooperation with the recording paper being supplied from the roll into the printer for said pre-cutting process;

a holding member for holding said pre-cut detection member in the second position;

a resetting member for resetting said pre-cut detection member to the first position when the roll of recording paper or a spool of the roll is removed from the paper magazine; and a detection switch for outputting said pre-cut data of the first value when it detects that said pre-cut detection member is in the first position, and outputting said pre-cut data of the second value while said pre-cut detection member is in the second position.

4. A printer as recited in claim 3, wherein the first position of said pre-cut detection member is in a path along which the recording paper is supplied into the printer, and said pre-cut detection member is pushed from the first position to the second position by the leading end of the recording paper as being fed out for said pre-cutting process.

5. A printer as recited in claim 1, wherein said pre-cut memory device is an electronic memory, and said control device writes said pre-cut data in said electronic memory.

6. A printer as recited in claim 5, wherein the recording paper is removably contained in a paper magazine, and said electronic memory is provided in said paper magazine and connected to said control device by loading said paper magazine in the printer, said control device writing said pre-cut data of the second value in said electronic memory when said pre-cutting process is completed.

7. A printer as recited in claim 6, further comprising a roll detection device for detecting if the roll of recording paper is loaded in the paper magazine, wherein said control device rewrites said pre-cut data as the first value in said electronic memory when said roll detection device detects that the roll of recording paper is removed from the paper magazine.

* * * * *